US011541292B2

(12) United States Patent
Hunt et al.

(10) Patent No.: US 11,541,292 B2
(45) Date of Patent: Jan. 3, 2023

(54) BATTING TEE

(71) Applicant: Wilson Hunt International, Ltd., Wheeling, IL (US)

(72) Inventors: Ryan Hunt, Wheeling, IL (US); Matthew Klein, Wheeling, IL (US)

(73) Assignee: Wilson Hunt International, Ltd., Wheeling, IL (US)

( * ) Notice: Subject to any disclaimer, the term of this patent is extended or adjusted under 35 U.S.C. 154(b) by 0 days.

(21) Appl. No.: 17/198,919

(22) Filed: Mar. 11, 2021

(65) Prior Publication Data

US 2021/0197055 A1 Jul. 1, 2021

Related U.S. Application Data

(63) Continuation-in-part of application No. 16/841,076, filed on Apr. 6, 2020, now Pat. No. 11,285,374.

(60) Provisional application No. 62/988,139, filed on Mar. 11, 2020, provisional application No. 62/829,870, filed on Apr. 5, 2019.

(51) Int. Cl.

| | |
|---|---|
| ***A63B 69/36*** | (2006.01) |
| ***A63B 69/00*** | (2006.01) |
| *A63B 102/18* | (2015.01) |

(52) U.S. Cl.

CPC ..... *A63B 69/0075* (2013.01); *A63B 69/0002* (2013.01); *A63B 2069/0008* (2013.01); *A63B 2102/18* (2015.10); *A63B 2214/00* (2020.08); *A63B 2225/093* (2013.01)

(58) Field of Classification Search

CPC ..... A63B 69/0075; A63B 69/0002; A63B 2102/18; A63B 2214/00; A63B 2069/0008; A63B 2225/093; A63B 2071/0063; A63B 2071/0694; A63B 2209/14

USPC ..... 473/417–420, 422, 423, 451, 453

See application file for complete search history.

(56) References Cited

U.S. PATENT DOCUMENTS

| | | | | |
|---|---|---|---|---|
| 1,242,046 | A * | 10/1917 | Rogers | A63F 7/0608 273/317.9 |
| 3,006,647 | A | 10/1961 | Lee | |
| 3,139,282 | A * | 6/1964 | Lande | A63B 69/0075 473/417 |
| 3,883,138 | A * | 5/1975 | Chorey | A63B 69/0075 473/417 |
| 3,940,131 | A | 2/1976 | St. Claire, Jr. | |
| 4,819,937 | A * | 4/1989 | Gordon | A63B 69/0075 473/417 |
| 4,979,741 | A | 12/1990 | Butcher | |
| 5,087,039 | A | 2/1992 | Laseke | |
| 5,897,444 | A | 4/1999 | Hellyer | |
| 5,928,092 | A | 7/1999 | Keeter et al. | |
| 6,413,175 | B1 | 7/2002 | Mooney, Jr. | |
| 6,893,363 | B1 * | 5/2005 | Chen | A63B 69/0002 473/417 |
| 8,118,692 | B2 | 2/2012 | Day et al. | |
| 8,337,337 | B2 * | 12/2012 | Lay | A63B 69/0002 473/417 |
| 8,556,753 | B1 | 10/2013 | Dixon, Jr. | |

(Continued)

*Primary Examiner* — Nini F Legesse

(74) *Attorney, Agent, or Firm* — Boyle Fredrickson, S.C,

(57) ABSTRACT

A batting tee and/or hitting training device is provided that includes a platform, a support extending upwardly from the platform and a holder disposed on the support opposite the platform for holding the ball to be hit. The holder includes a lower tubular member and an upper ball-retaining portion that are integrally formed with one another.

9 Claims, 2 Drawing Sheets

(56) References Cited

U.S. PATENT DOCUMENTS

| | | | | |
|---|---|---|---|---|
| 8,597,143 | B2 * | 12/2013 | Newman | A63B 69/0075 473/417 |
| 8,821,322 | B1 * | 9/2014 | Jorgens | A63B 69/0075 473/417 |
| 9,352,204 | B2 | 5/2016 | Gardner et al. | |
| 9,358,440 | B1 * | 6/2016 | Burrell | A63B 69/0002 |
| 9,649,544 | B2 | 5/2017 | Fitzpatrick et al. | |
| 9,700,777 | B2 | 7/2017 | Ditz, Jr. | |
| D870,219 | S | 12/2019 | Pippitt et al. | |
| D870,220 | S | 12/2019 | Pippitt et al. | |
| 10,583,343 | B2 | 3/2020 | Pippitt et al. | |
| 2004/0185968 | A1 * | 9/2004 | Livingstone | A63B 69/0075 473/417 |
| 2005/0143196 | A1 * | 6/2005 | Tsai | A63B 69/0002 473/417 |
| 2006/0019773 | A1 * | 1/2006 | Newman | A63B 69/0075 473/417 |
| 2006/0264273 | A1 * | 11/2006 | Liao | A63B 69/0075 473/417 |
| 2015/0343289 | A1 | 12/2015 | Gardner et al. | |
| 2018/0036615 | A1 * | 2/2018 | Thurber | A63B 69/0091 |
| 2018/6169493 | | 6/2018 | Gardner et al. | |

* cited by examiner

BATTING TEE

CROSS-REFERENCE TO RELATED APPLICATIONS

This application claims priority from U.S. Provisional Patent Application Ser. No. 62/988,139, filed on Mar. 11, 2020, and is a continuation-in-part of U.S. Non-Provisional patent application Ser. No. 16/841,076, filed on Apr. 6, 2020, entitled Batting Tee, which in turn claims priority from U.S. Provisional Patent Application Ser. No. 62/829,870, filed on Apr. 5, 2019, the entirety of which are each expressly incorporated by reference herein for all purposes.

FIELD OF THE DISCLOSURE

This disclosure relates to a batting tee or similar device for use in training an individual in sports requiring the participant to hit a ball with an object, such as a bat.

BACKGROUND OF THE DISCLOSURE

In the past a variety of different types of devices have been developed to provide an individual with the opportunity to practice hitting a ball, such as a sports ball, that is thrown at the individual. To enable a beginner to develop the necessary muscle memory to hit a moving ball, the training devices often enable the individual to hit a ball positioned in a stationary position on the training device.

These devices can take many forms and often are constructed with a platform placed on the ground, a support extending upwardly from the platform and a ball holder disposed on the support opposite the platform. The device is utilized by placing the device on a flat surface where the individual can take the necessary stance for hitting a ball, placing the ball on the holder and allowing the individual to swing the bat or other implement at the ball located in a stationary position on the holder.

However, while capable of allowing an individual to practice swinging the bat to hit the ball in a stationary position on the device, these prior art devices normally include multiple pieces in their construction that can must be connected to one another to form the device. In particular, in prior art devices the holder for the ball is formed separately from the support to hold the ball over the support, with the holder disposed at a top end of the support. As a result, the holder requires a connection between the holder and the top end of the support to maintain the proper position of the holder on the support.

The connections between the pieces or components are created by various types of mechanisms that are formed separately from the components and hold the components in the orientation required for the proper operation of the device.

However, during normal use of the device, the parts forming the connections can become worn or broken preventing the device from being used properly. Further, during normal use any of the connections required to engage all of the components of the device with one another can readily become separated, requiring the components to be reconnected before proper use of the device can continue. This is particularly the case when the components of the prior art devices are struck by inaccurate swings by the individual that cause the connections between the components to become separated or damaged, such as when the holder is struck below the ball, thereby damaging the connection between the holder and the support and separating the holder from the support.

Therefore, it is desirable to provide a batting tee/training device that includes a more robust construction that can more readily withstand damage between the holder and the support while providing a stable location fir supporting the ball to be hit thereon.

SUMMARY OF THE DISCLOSURE

According to one aspect of an exemplary embodiment of the disclosure, a batting tee and/or hitting training device is provided that includes a platform, a support extending upwardly from the platform and a holder disposed on the support opposite the platform for holding the ball to be hit. The holder is formed of a single piece including a tube engaged with the support and forming an adjustable portion of the support, and a cone disposed on the holder opposite the support. The cone is flexible to enable the cone to provide a stable location to support a ball to be hit thereon, while also being able to withstand repeated strikes when in use. Further, the single piece construction of the holder and tube greatly simplifies the construction of the tee and enables the tee to be more readily adjusted for use with individuals of varying heights.

According to another aspect of an exemplary embodiment of the disclosure, the construction of the holder with the adjustable tube eliminates a connection and associated connection mechanism between the holder and the support. Thus, the holder is maintained in engagement with the support without the need for any additional connection, negating the separation of the holder from the support during use of the training device.

According to still another aspect of an exemplary embodiment of the disclosure, the holder and adjustable tube construction includes a material that provides a significant resistance to damage from inadvertent or inaccurate swings that contact the holder and/or the support tube.

Numerous additional aspects, features and advantages of the present disclosure will be made apparent from the following detailed description taken together with the drawing figures.

BRIEF DESCRIPTION OF THE DRAWINGS

The drawings illustrate the best mode of practicing the present disclosure.

In the drawings.

DETAILED DESCRIPTION OF THE DRAWINGS

Figure 1:
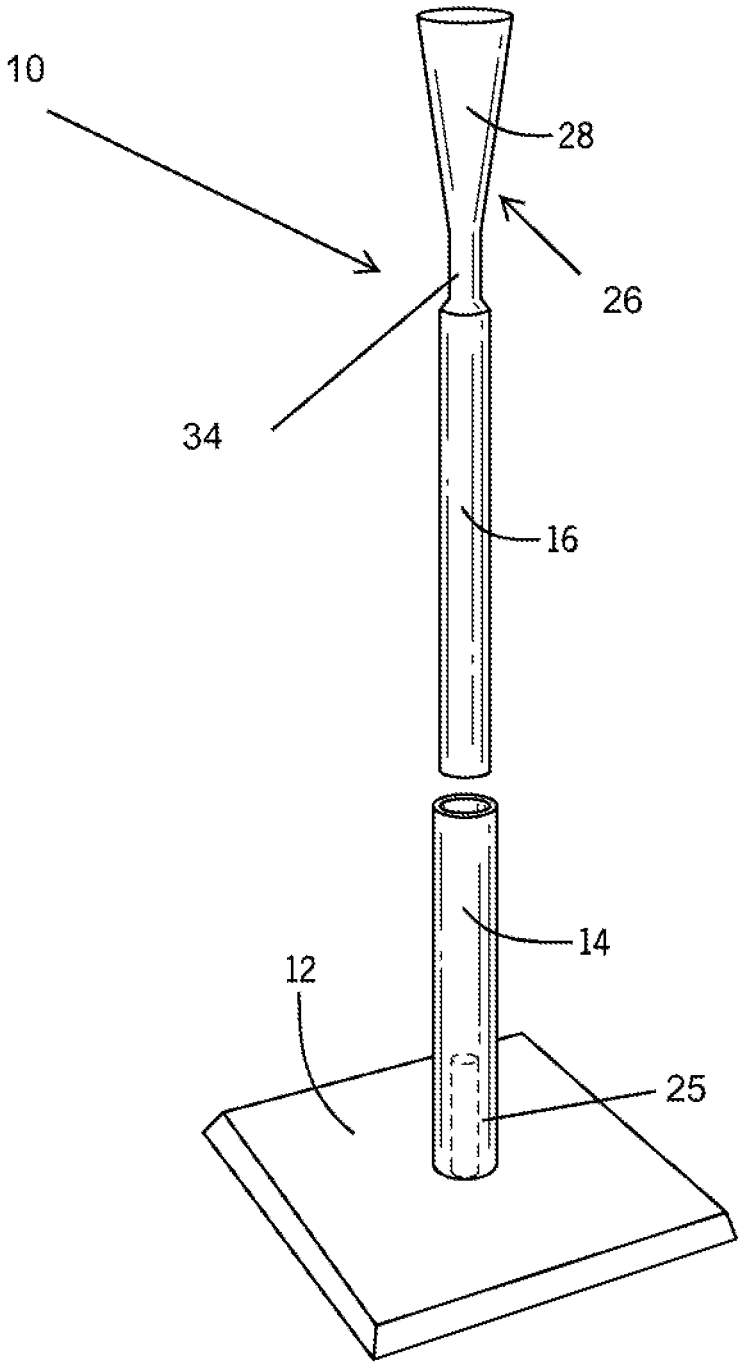
FIG. 1 is a partially exploded, isometric view of a batting tee according to an exemplary embodiment of the disclosure.

With reference now to the drawing figures in which like reference numbers represent like features throughout the application, one exemplary embodiment of a batting tee or device constructed according to the present disclosure is indicated generally at 10 in FIG. 1. The device 10 includes a platform 12 that is adapted to be disposed on a surface, such as the ground, a support 14 extending vertically upwardly from the platform 12 and a holder 16 located on the support 14 opposite the platform 12. The members 12, 14, 16 are formed of any suitable material and in an exemplary embodiment are formed of a plastic and/or rubber material that provides sufficient flexibility and strength and weight to the device 10.

Figure 2:
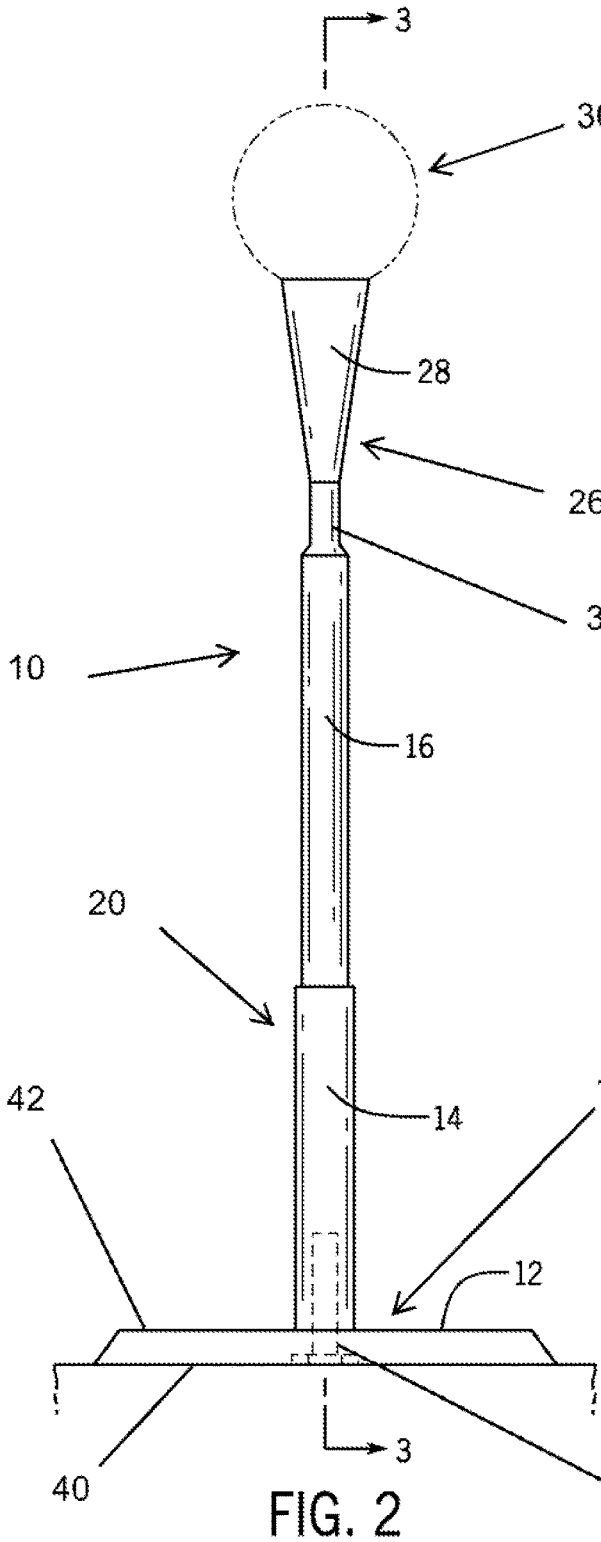
FIG. 2 is a side elevation view of the batting tee of FIG. 1.
Figure 3:
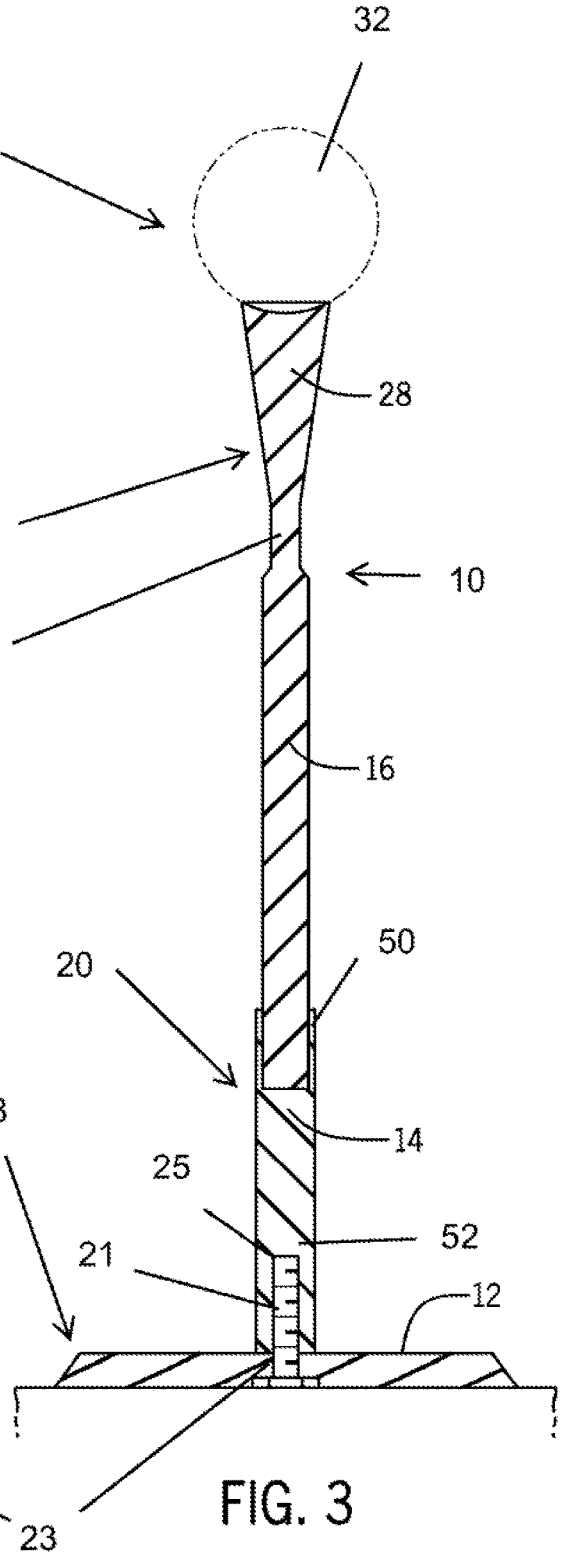
FIG. 3 is a cross-sectional view along line 3-3 of FIG. 2.

As shown in the exemplary illustrated embodiment of FIGS. 1-3, the platform 12 can be formed of a generally flat member 18 that is shaped to resemble a base or other structure, and has sufficient area to provide a stable base for the device 10 when in use. The platform 12 includes a flat lower surface 40, optionally including recesses (not shown), that is positioned on the ground or other support surface. The platform 12 also includes an upper surface 42. The platform 12 has a sufficient size/area and weight to prevent inadvertent tipping of the device 10, even while in use. To assist in providing this stability for the device 10, the platform 12 can be formed of a rubber material that enables the platform 12 to have sufficient weight to prevent the platform 12 from readily being flipped or moved off of the ground/support surface.

The support 14 can be formed as desired, and in the illustrated exemplary embodiment of FIGS. 1-3 formed from a tubular member 20. The tubular member 20 is formed from a material capable of providing a semi-rigid nature to the tubular member 20, while also providing additional weight to the platform 12 to prevent tipping of the device 10 when in use, such as a rubber material. Tubular member 20 can be formed as a hollow tube, as a solid cylindrical member, or a combination thereof, such as with an upper hollow section 50 and a lower solid section 52. The tubular member 20 is attached to the platform 12 at one end, such as by a bolt or shall 21 inserted through an engaged with the platform 12 around an aperture 23 extending through the platform 12 and into engagement with a bore 25 formed in the lower solid section 52 of the tubular member 20. The bolt/shaft 21 can also be formed as a part of the platform 12, negating the need for the aperture 23. The shaft 21 is secured within the bore 25 in any suitable manner, such as by engaging a fastener (not shown) disposed within the bore 25, or by other mechanical means, such as a friction fit between the exterior of the shaft 21 and the interior of the bore 25, which are sized to have closely similar diameters to provide the friction fit. In one exemplary embodiment, the lengths of the shaft 21 and the bore 25 are such that the bore 25 can only be displaced vertically with regard to the shaft 21 to assist in holding the support 14 vertically on the platform 12.

Referring now to the illustrated exemplary embodiment of FIGS. 1-3, the holder 16 is formed with a lower tubular member 22. The lower tubular member 22 is formed of a material similar to that used for the support 14, e.g., a rubber material, and has an exterior diameter less than that of the interior of the upper hollow section 50 of the tubular member 20, such that lower tubular member 22 can be slid telescopically relative to tubular member 20. The exterior diameter of the lower tubular member 22 allows the lower tubular member 22 to move with regard to the interior of the tubular member 20 while also contacting the interior of the upper hollow section 50 to provide the friction fit sufficient to retain the lower tubular member 22 in the desired position relative to the upper hollow section 50. With this construction it is possible to extend the support holder 16 from a collapsed or storage position, where a majority of lower tubular member 22 is disposed within the upper hollow section 50 of the tubular member 20, to an extended or use position where a majority of lower tubular member 22 is positioned outside of above the upper hollow section 50 of the tubular member 20. Alternatively, the upper hollow section 50 can be formed with a length sufficient to retain the lower tubular member 22 in a single position or height relative to the tubular member 20, further simplifying the construction of the device 10.

Opposite the lower tubular member 22, the holder 16 includes an upper ball-holding portion 26 including a flexible cone or cup-shaped receptacle 28 extending away from the lower tubular member 22. The cup-shaped receptacle 28 has a width and depth sufficient to receive and retain at least portion of a ball 30 therein, such as a baseball 32, in order to retain the ball 30 in a stable stationary position within the receptacle 28.

The upper portion 26 is formed integrally with the lower tubular member 22 of the holder 16, such as in a suitable molding process, with a narrowed section 34 connecting the upper portion 26 and the tubular member 22 to one another, and without any other connection between the lower tubular member 22 and the upper portion 26. In the illustrated exemplary embodiment, the lower tubular member 22 and the narrowed section 34 are formed as solid cylinders of the semi-rigid material, e.g., the rubber, while the upper portion 26 is formed as a hollow cone. The solid material forming the lower tubular member 22 and the narrowed section 34 enable the lower tubular member 22 and the narrowed section to withstand a large amount of force, such as from a bat swung at the device 10. The narrowed section 34 also enables the upper portion 26 to flex or move with respect to the lower tubular member 22 when the upper portion 26 is struck, such as by a bat (not shown), to reduce damage to the upper portion 26 during use of the batting tee 10. Additionally, the solid lower tubular member 22 can be easily manipulated to engage the holder 16 with the upper hollow section 50 to the desired position.

Various other alternatives are contemplated is being within the scope of the following claims particularly pointing out and distinctly claiming the subject matter regarded as the invention.

We claim:

1. A hitting training device comprising:

a) a vertical support;

b) a holder secured to the support, the holder including a lower tubular member and an upper ball-holding portion integrally formed with one another, wherein the holder comprises a narrow section connecting the lower tubular member and the upper ball-holding portion, wherein the lower tubular member is formed as a solid cylinder, wherein the narrow section is formed as a solid cylinder, wherein the upper ball-holding portion is formed as a solid cone; and wherein the vertical support consists of an upper hollow section that receives the lower tubular member and a lower solid section formed together as a single tubular piece.

2. The device of claim 1, wherein the holder is formed of a rubber.

3. The device of claim 1, comprising a platform operably connected to the lower solid section.

4. The device of claim 3, wherein the platform comprises a shaft extending outwardly therefrom and engageable with the lower solid section.

5. The device of claim 4, wherein the lower solid section includes a bore in which the shaft is releasably positioned.

6. The device of claim 4, wherein the shaft is releasably connected to the platform.

7. The device of claim 1, wherein the lower tubular member has an outer diameter less than an inner diameter of the upper hollow portion.

8. The device of claim 7, wherein the lower tubular member is telescopically engaged with the upper hollow section.

9. A method for training a swing path, the method comprising the steps of:

a) providing the hitting training device of claim 1; and b) positioning the holder relative to the vertical support to provide a desired height for the desired hitting device.

* * * * *